US005875837A

United States Patent [19]

Hughes

[11] Patent Number: 5,875,837

[45] Date of Patent: Mar. 2, 1999

[54] LIQUID COOLED TWO PHASE HEAT EXCHANGER

[75] Inventor: Gregory G. Hughes, Milwaukee, Wis.

[73] Assignee: Modine Manufacturing Company, Racine, Wis.

[21] Appl. No.: 7,663

[22] Filed: Jan. 15, 1998

[51] Int. Cl.[6] ..... F28D 7/08

[52] U.S. Cl. ..... 165/140; 165/150

[58] Field of Search ..... 165/67, 153, 140, 165/144, 145, 150, 149

[56] References Cited

U.S. PATENT DOCUMENTS

| | | | |
|---|---|---|---|
| 1,720,768 | 7/1929 | Spreen | 165/140 X |
| 1,787,118 | 12/1930 | Murray | 165/145 |
| 1,901,090 | 3/1933 | Eule et al. | 165/140 X |
| 2,003,122 | 5/1935 | Schwarz | 165/140 X |
| 5,036,909 | 8/1991 | Whitehead et al. | 165/150 X |
| 5,197,539 | 3/1993 | Hughes et al. | 165/150 X |
| 5,211,222 | 5/1993 | Shinmura | 165/153 X |
| 5,360,059 | 11/1994 | Olson | 165/149 |
| 5,404,940 | 4/1995 | Van Den Nieuwenhuizen et al. | 165/149 |
| 5,605,191 | 2/1997 | Eto et al. | 165/153 X |

FOREIGN PATENT DOCUMENTS

| | | | |
|---|---|---|---|
| 610005 | 12/1960 | Canada | 165/140 |
| 2705178 | 9/1977 | Germany | 165/150 |
| 49992 | 3/1986 | Japan | 165/140 |
| 68297 | 3/1992 | Japan | 165/150 |
| 1092355 | 5/1984 | U.S.S.R. | 165/140 |

*Primary Examiner*—Leonard R. Leo

*Attorney, Agent, or Firm*—Wood, Phillips, VanSanten, Clark & Mortimer

[57] ABSTRACT

A highly efficient liquid cooled, two phase heat exchanger includes a plurality of plate-like flattened tubes (22) in spaced, side-by-side relation. Header plates (10, 12) are located at the ends of the plate-like flattened tubes (22) and receive the same in sealed relation. Tanks (14, 16) are sealed to each of the header plates (10, 12). A liquid inlet (18) is provided to one of the tanks 14 while a liquid outlet (20) is provided to one of the tanks (16). A plurality of flattened serpentine tubes (40) in side-by-side relation are provided and each has a plurality of generated parallel, straight runs (42) located between its ends. A pair of headers (30,32) receive the ends of the serpentine tubes (40) and are in generally parallel relation. Each of the plate-like flattened tubes (22) is in nested relation between two adjacent straight runs (42) of the serpentine tubes (40) in heat exchange relation therewith and each of the serpentine tubes (40) is located between the header plates (10, 12).

9 Claims, 3 Drawing Sheets

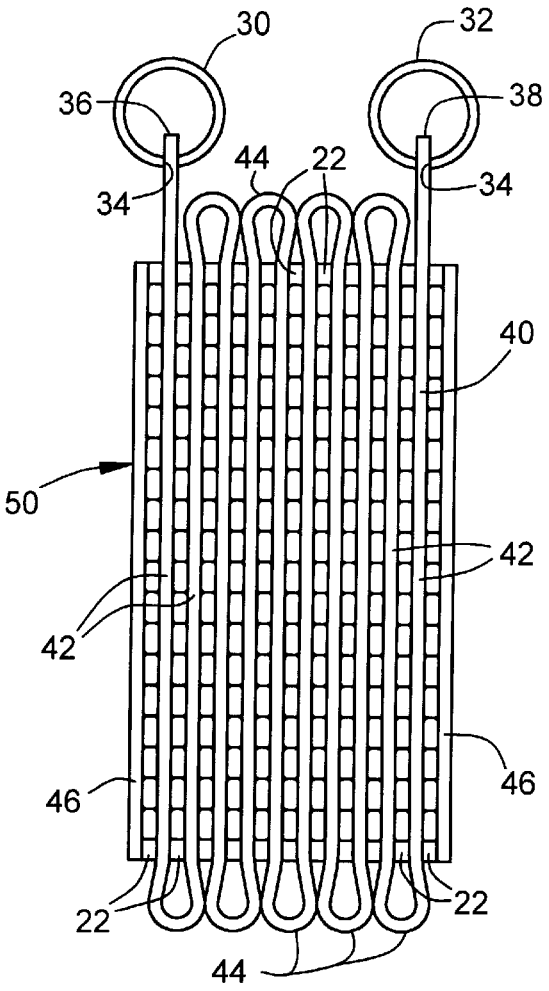
FIG. 3
FIG. 4
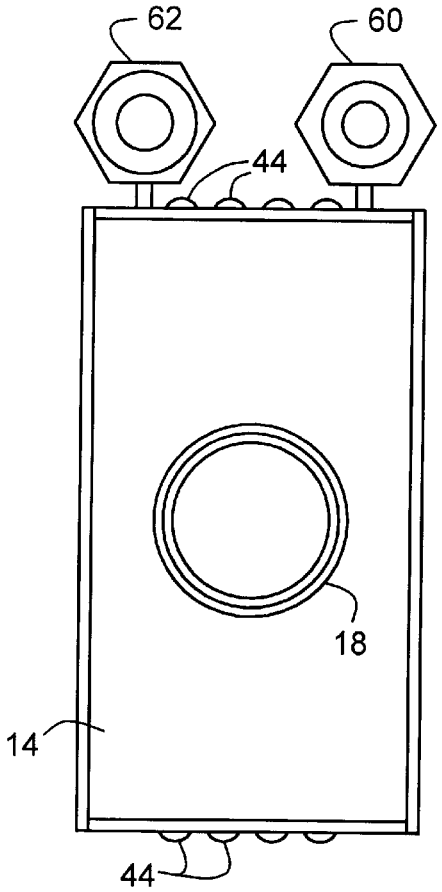

LIQUID COOLED TWO PHASE HEAT EXCHANGER

FIELD OF THE INVENTION

This invention relates to heat exchangers, and more specifically, to a liquid cooled two phase heat exchanger wherein one fluid undergoes a phase change from the vapor phase to the liquid phase or from the liquid phase to the vapor phase as a result of heat exchange with a liquid.

BACKGROUND OF THE INVENTION

The last several decades have seen increasing concern about the effects of internal combustion engines on the environment. Such engines are, of course, the overwhelming choice for the power plant of vehicles of all sizes and shapes. Some of the concerns are related to energy conservation while others relate to emissions.

A number of the problems to be solved, and the approaches to their solution, are interactive. For example, improved efficiency of power consuming systems on a vehicle reduces fuel consumption which serves both energy conservation concerns and concerns about emissions.

In U.S. Pat. Nos. 5,408,843 and 5,520,015, both to Lukas et al, and issued respectively on Apr. 25, 1995 and May 28, 1996, there is disclosed a vehicular cooling system that addresses the foregoing concerns. Both the patents are owned by the assignee of the instant application and their entire disclosures are herein incorporated by reference.

In the system disclosed in the aforementioned patents, a liquid cooled condenser is employed in the vehicular air conditioning system. The condenser condenses refrigerant from the vapor phase to the liquid phase to recycle it to an evaporator where it is evaporated to provide cooling for some part of the vehicle. As disclosed in the Lukas patents, the evaporator is air cooled but in some instances, particularly where it is desirable to have refrigerant lines of minimal lengths so as to reduce refrigerant charge volume and where the location to be cooled is somewhat remote from the air conditioning system, it may be desirable to provide a cooled liquid to the point whereat cooling is required, which liquid is cooled by an evaporator located close to the other components of the air conditioning system.

The present invention is directed to providing a new and improved liquid cooled, two phase heat exchanger for use in systems such as those disclosed in the Lukas patents or anywhere else where heat exchange between a liquid and a fluid changing from the liquid phase to the vapor phase or vice versa is desirable.

SUMMARY OF THE INVENTION

It is the principal object of the invention to provide a new and improved liquid cooled, two phase heat exchanger.

More specifically, it is an object of the invention to provide a liquid cooled, two phase heat exchanger that includes a plurality of plate-like flattened tubes in spaced, side-by-side relation. Header plates are located at the ends of the plate-like flattened tubes and receive the same in sealed relation. Tanks are secured to each of the header plates and a liquid inlet to one of the tanks is provided. A liquid outlet for one of the tanks is also provided. A plurality of flattened serpentine tubes in side-by-side relation are also included and each of the serpentine tubes has ends and a plurality of generally parallel, straight runs located between the ends of the serpentine tubes. A pair of headers are provided with each receiving and sealed to corresponding ends of the serpentine tubes in generally parallel relation. Each of the plate-like flattened tubes is nested between two adjacent straight runs of the serpentine tubes in heat exchange relation. Each of the serpentine tubes is located between the header plates.

In a preferred embodiment, the plate-like tubes and the serpentine tubes form a compressed stack.

In a highly preferred invention, each of the serpentine tubes has a round connecting adjacent straight runs in a serial fashion and the rounds have a bulbous shape when compressed into the stack.

In one embodiment, each of the plate-like tubes has a plurality of internal webs defining a plurality of flow paths. Preferably, the straight runs are generally transverse to the flow paths.

In one embodiment, the headers of the pair are tubular.

Other objects and advantages will become apparent from the following specification taken in connection with the accompanying drawings.

BRIEF DESCRIPTION OF THE DRAWINGS

FIG. 3 is a sectional view taken approximately along the line 3—3 in FIG. 1;

FIG. 4 is an end elevation of the heat exchanger;

DESCRIPTION OF THE PREFERRED EMBODIMENTS

Figure 1:
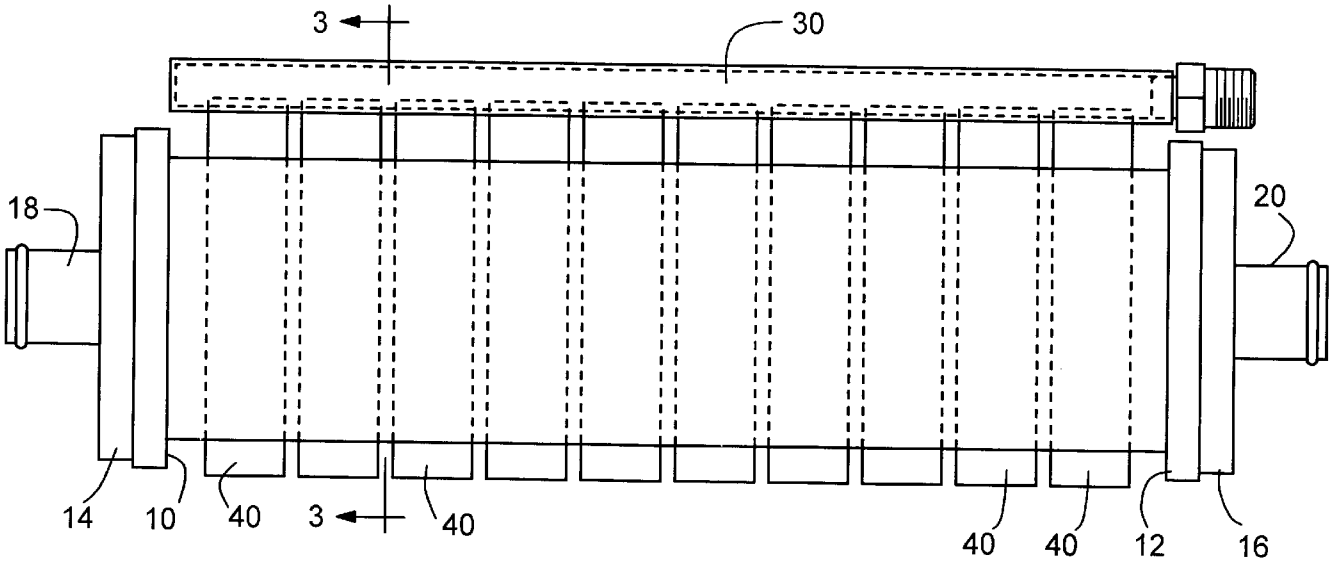
FIG. 1 is a side elevation of a liquid cooled, two phase heat exchanger made according to the invention.

An exemplary embodiment of a liquid cooled, two phase heat exchanger, made according to the invention is illustrated in the drawings. The same is intended to be used as a liquid cooled condenser or evaporator as desired but may find efficacy as a heat exchanger used for other purposes.

Figure 2:
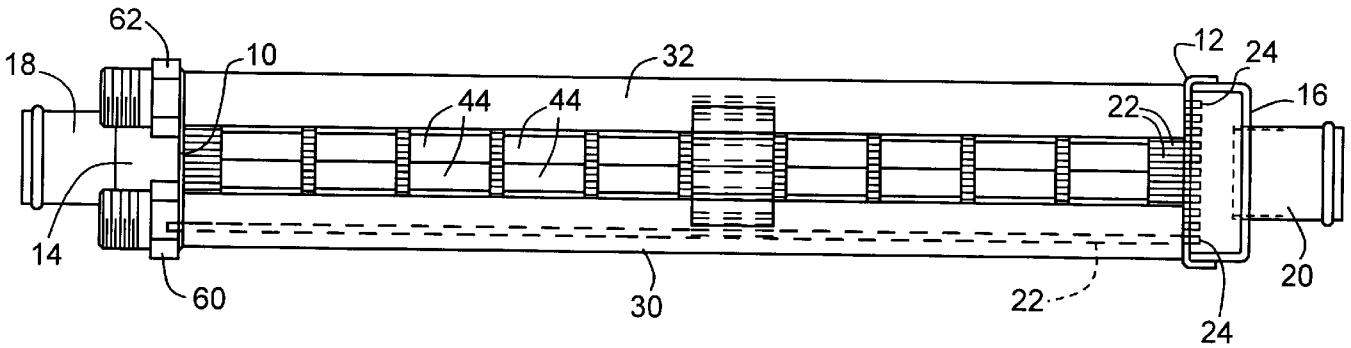
FIG. 2 is a plan view of the heat exchanger.

Referring to FIGS. 1 and 2, the heat exchanger includes spaced, opposed header plates 10,12. Each of the header plates 10 and 12 receives an associated tank 14,16. The tank 14 includes a liquid inlet 18 while the tank 16 includes a liquid outlet 20. It should be recognized, however, that in some instances, the inlet 18 and the outlet 20 may be connected to the same tank with direct liquid flow between the two being precluded by an internal baffle (not shown). That is to say, that while the illustrated embodiment is a single pass heat exchanger on the liquid side, it may be multiple pass if desired.

A plurality of flattened, plate-like tubes 22 best seen in FIG. 3 extend between the header plates 10 and 12. As seen in FIG. 2, ends 24 of the tubes 22 extend through slots (not shown) in the header plates 10 and 12 and are sealed thereto as, for example, by brazing. As a consequence, the interiors of each of the tanks 14 and 16 are in fluid communication with the tubes 22.

Also as seen in FIGS. 2 and 3, the plate-like tubes 22 are generally parallel to one another and in spaced relation.

According to the invention, to one side of the plate-like tubes 22, a pair of generally cylindrical header/tanks 30,32, extend in generally spaced relationship and in parallel with one another. The header/tanks 30,32 include slots 34 which receive opposed ends 36,38 of a plurality of serpentine tubes 40. The serpentine tubes 40 are typically extruded, multiport tubes, each having a plurality of internal flow paths of relatively small hydraulic diameter, that is, a hydraulic diameter of up to about 0.07 inches. The ends 34 are sealed to the respective header/tanks 30,32 in a conventional fashion as, for example, by brazing.

Intermediate the ends 34 of each serpentine tube 40 there are a plurality of straight runs 42. Adjacent ones of the straight runs 42 are connected by rounds 44 which extend beyond the sides of the flattened plate-like tubes 22.

Figure 5:
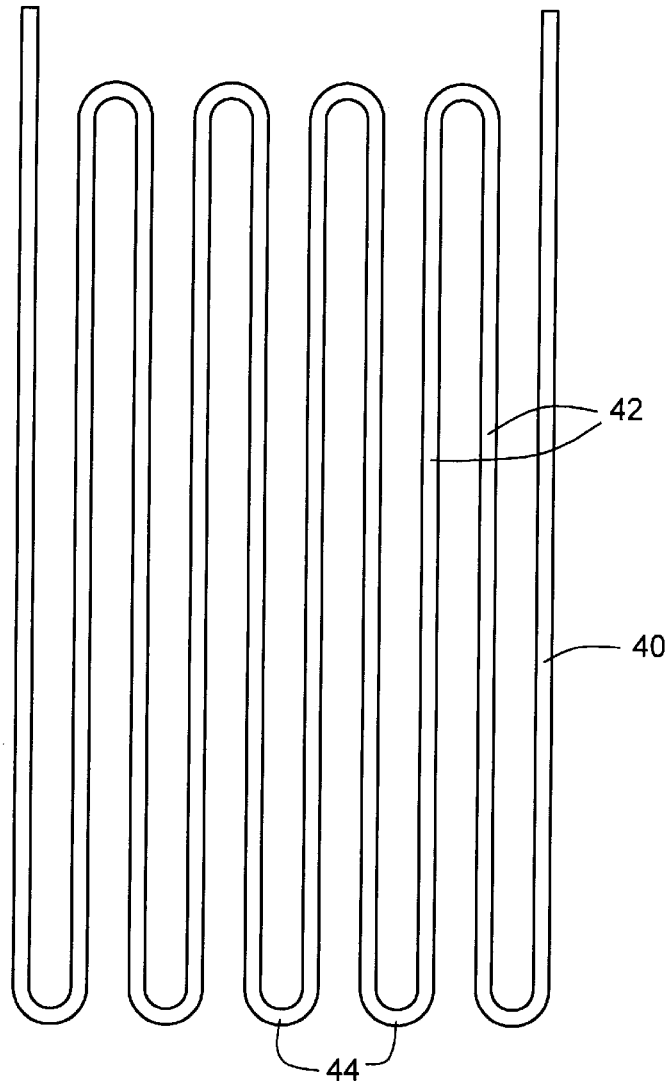
FIG. 5 is an elevation of a serpentine tube employed in the invention.

Referring to FIG. 5, the rounds 44 provide 180° reversal of the serpentine tubes 40 between the straight runs 42 to define a serial flow path.

As seen in FIG. 1, the serpentine tubes 40 are located in generally side-by-side relation and disposed between the header plates 10 and 12. As seen in FIG. 3, the flattened plate-like tubes 22 are nested between adjacent straight runs 42 of the serpentine tubes 40.

Initially, the serpentine tubes will have the configuration illustrated in FIG. 5. After the plate-like flattened tubes 22 have been nested between the straight runs 42, and tubes 22 applied to the endmost straight runs 42, side plates 46 are applied to the endmost plate-like flattened tubes 22 and by means of any suitable fixture, pressure is applied to compress the end plates 46, the plate-like flattened tubes 22 and the straight runs 42 of the serpentine tubes 40 into a stack, generally designated 50, as seen in FIG. 3 and ultimately brazed together. This stack will typically be rectangular in configuration and as a result of the compression, where the rounds 44 extend out of the stack, they assume a bulbous configuration as illustrated in FIG. 3.

Figure 6:
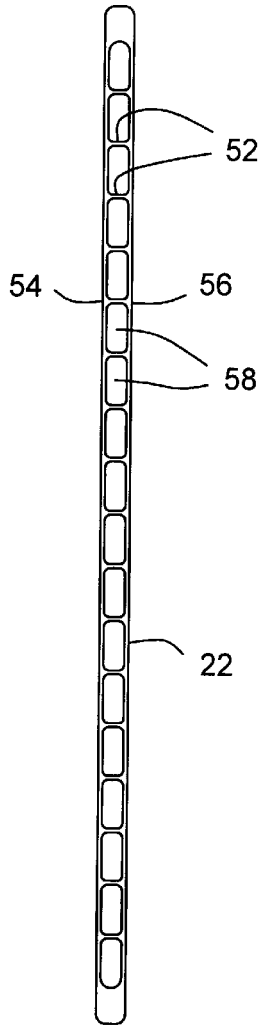
FIG. 6 is a sectional view of a plate-like, flattened tube employed in the invention.

Referring to FIG. 6, the plate-like, flattened tubes 22 are seen to include a plurality of internal webs 52 extending between opposite sides 54,56 to define a plurality of discrete flow paths 58 through each of the flattened, plate-like tubes 22. The flow paths 58 are generally transverse to the straight runs 42 and vice versa. Similar webs are, of course, located within the serpentine tube 40 and serve to prevent collapse during the compression process as well as to provide pressure resistance during the use of the heat exchanger.

In operation, a liquid coolant may be flowed into the inlet 18 to enter the tank 14. From the tank 14, the liquid coolant will enter the ends of the plate-like, flattened tubes 22 to flow through the flow paths 58 to enter the tank 16 and emerge from the outlet 20. Because the components are compressed into the stack 50 and brazed together as mentioned previously, good heat exchange contact between the flattened, plate-like tubes 22 and the straight runs 42 of the serpentine tubes 40 is established. A refrigerant may be flowed into the serpentine tubes 40 via, for example, a fixture 60 on one end of the header 30. From there, the refrigerant will flow through each of the serpentine tubes 40. As the refrigerant flows through the straight runs 42 thereof, it will exchange heat with the liquid in the flattened, plate-like tubes 22. Ultimately, the refrigerant will emerge into the header 32 to be conducted to a fixture 62 where it may be returned to the remainder of the system.

As illustrated, where the fixture 60 serves as the inlet to the refrigerant side of the system, because of its relatively smaller size, a liquid refrigerant will be introduced thereat. The refrigerant in a vapor phase will be recovered from the fixture 62. In this case, the heat exchanger is being utilized as an evaporator and will cool the coolant passing through the flattened, plate-like tubes 22. Alternatively, when used as a condenser, vaporous refrigerant will be flowed into the larger fixture 62 and emerge from the smaller fixture 60. The vaporous refrigerant will be cooled and condensed within the serpentine tubes 40 by the coolant flowing through the plate-like, flattened tubes 22. In this case, the heat exchanger is being employed as a condenser.

From the foregoing, it will be appreciated that a heat exchanger made according to the invention is extremely compact and yet provides intimate contact between the tubes making up the various flow paths to provide excellent heat exchange. A high performance to volume ratio is accordingly obtained.

What is claimed is:

1. A heat exchanger, comprising:

a plurality of plate-like flattened tubes in spaced side-by-side relation and having opposed ends;

header plates at each of said ends and receiving said ends in sealed relation;

a plurality of tanks, one secured to each of said header plates;

a liquid inlet to one of said tanks;

a liquid outlet to one of said tanks;

a plurality of flattened serpentine tubes in side-by-side relation, each of said serpentine tubes having ends and a plurality of generally parallel, straight runs located between said serpentine tube ends; and a pair of headers, each receiving and sealed to corresponding ends of said serpentine tubes and in generally parallel relation;

each said plate-like flattened tube being nested between two adjacent straight runs of each of said serpentine tubes and in abutting heat exchange relation therewith;

each of said serpentine tubes being located between said header plates.

2. The heat exchanger of claim 1 wherein said plate-like tubes and said serpentine tubes form a compressed stack.

3. The heat exchanger of claim 2 wherein each of said serpentine tubes has a round connecting adjacent straight runs in a serial fashion and said rounds have a bulbous shape when in said compressed stack.

4. The heat exchanger of claim 1 wherein each of said platelike tubes has a plurality of internal webs defining a plurality of flow paths.

5. The heat exchanger of claim 4 wherein said straight runs are generally transverse to said flow paths.

6. The heat exchanger of claim 1 wherein the headers of said pair are tubular.

7. A heat exchanger, comprising:

a plurality of multiport plate-like flattened tubes in spaced side-by-side relation and having opposed ends;

header plates at each of said ends and receiving said ends in sealed relation;

a plurality of tanks, one secured to each of said header plates;

a liquid inlet to one of said tanks;

a liquid outlet to one of said tanks;

a plurality of flattened serpentine tubes in side-by-side relation, each of said serpentine tubes having ends and a plurality of generally parallel, straight runs connected by rounds and located between said serpentine tube ends; and a pair of tubular headers, each receiving and sealed to corresponding ends of said serpentine tubes and in generally parallel relation;

each said plate-like flattened tube being nested between two adjacent straight runs of each of said serpentine tubes and in abutting heat exchange relation therewith;

each of said serpentine tubes being located between said header plates with said rounds extending beyond said plate-like flattened tubes; and side plates on two opposed sides of said plate-like flattened tubes and parallel thereto and extending generally between said headers, said side plates compressing said plate-like flattened tubes and said straight runs into a stack to provide excellent heat exchange contact between said plate-like flattened tubes and said straight runs.

8. The heat exchanger of claim 7 wherein the headers of said pair are both one side of said stack.

9. The heat exchanger of claim 8 wherein some of said rounds extend from said one side of said stack and others of said rounds extend from the side of the stack opposite said one side, said rounds assuming a bulbous configuration as a result of compression by said side plates.

* * * * *